US005989065A

United States Patent [19]

Lazaro, Jr.

[11] Patent Number: 5,989,065

[45] Date of Patent: Nov. 23, 1999

[54] HIGH PERFORMANCE MIL-C-26500

[75] Inventor: Luis J. Lazaro, Jr., Shoreline, Wash.

[73] Assignee: The Boeing Company

[21] Appl. No.: 08/986,378

[22] Filed: Dec. 8, 1997

Related U.S. Application Data

[63] Continuation-in-part of application No. 08/687,082, Jul. 23, 1996, abandoned, which is a continuation-in-part of application No. 08/521,776, Aug. 31, 1995, abandoned, which is a continuation-in-part of application No. 08/435,122, May 5, 1995, abandoned.

[51] Int. Cl.[6] ..... H01R 13/40

[52] U.S. Cl. ..... 439/589

[58] Field of Search ..... 439/271–276, 439/586–589, 595, 600, 601, 281–283

[56] References Cited

U.S. PATENT DOCUMENTS

| | | | |
|---|---|---|---|
| 2,700,140 | 1/1955 | Phillips | 439/589 |
| 3,477,061 | 11/1969 | Stephenson | 439/589 |
| 3,970,352 | 7/1976 | Dorrell et al. | 439/589 |
| 4,220,385 | 9/1980 | Luca, Jr. et al. | 439/589 |
| 4,795,354 | 1/1989 | Owen | 439/271 |
| 5,240,433 | 8/1993 | Kato | 439/587 |
| 5,478,259 | 12/1995 | Noschese | 439/108 |

*Primary Examiner*—Khiem Nguyen
*Attorney, Agent, or Firm*—Conrad O. Gardner

[57] ABSTRACT

An improved MIL-C-26500 type electrical connector having improved environment resisting wire sealing webs, a hard dielectric face socket insert to detect splayed or bent pins, and a controlled configuration of contact retention clips providing improved electrical performance, easy insertion and removal of contacts and improved assembly, serviceability and maintainability. Additionally, the Mil-C-26500 receptacle circular connector having a set of ground wave-springs assembled on the receptacle connector flange to assure a secure ground path on electrically bonded connectors.

17 Claims, 4 Drawing Sheets

HIGH PERFORMANCE MIL-C-26500

RELATED APPLICATIONS

This application is a continuation-in-part of application Ser. No. 08/687,082, filed Jul. 23, 1996, which was a continuation-in-part of application Ser. No. 08/521,776, filed Aug. 31, 1995 which was a continuation-in-part of application Ser. No. 08/435,122 filed May 5, 1995 all of which have been abandoned.

SUMMARY OF THE INVENTION

A preferred embodiment of the present invention utilizes a Mil-C-26500 type electrical circular connector having an improved environment resisting rubber grommet, hard dielectric face socket insert and user friendly contact retention clips and ground wavesprings on the receptacle connector.

It is an object of the present invention to eliminate waste associated with Mil-C-26500 type connector assembly and increase reliability and maintainability of the electrical connectors. As will be hereinafter appreciated, the present invention significantly lowers cost in the assembly of connectors and greatly improves the interconnection between the plug and receptacle connectors thereby avoiding discontinuities.

Another object of the invention is to maintain Mil-C-25600 connector environment resistivity.

A further object of the invention is to ensure proper mating or coupling on the electrical pin and socket contacts when splayed or bent contacts are affected.

Yet another object of the invention is to eliminate manufacturers variation on the construction of the contact retention clips and institute ease of assembly or disassembly of the electrical contacts.

A still further object of the invention is to provide a set of straight wavespring that becomes effective to assist the connector mounting screws in maintaining a secure ground path on the aircraft connectors that requires electrical bonding.

The present invention provides Mil-C-25600 type electrical connectors with improved wire sealing webs, provision of a hard dielectric face socket insert to detect splayed or bent electrical contacts, user friendly retention clips which enhance insertion and removal of contacts resulting in elimination of damaged or push back retention clips and ground wavesprings for improved and reliable electrical connector bonding and grounding. By reason of improved electrical characteristics, the mechanical construction is also improved.

DETAILED DESCRIPTION OF THE INVENTION

Figure 1:
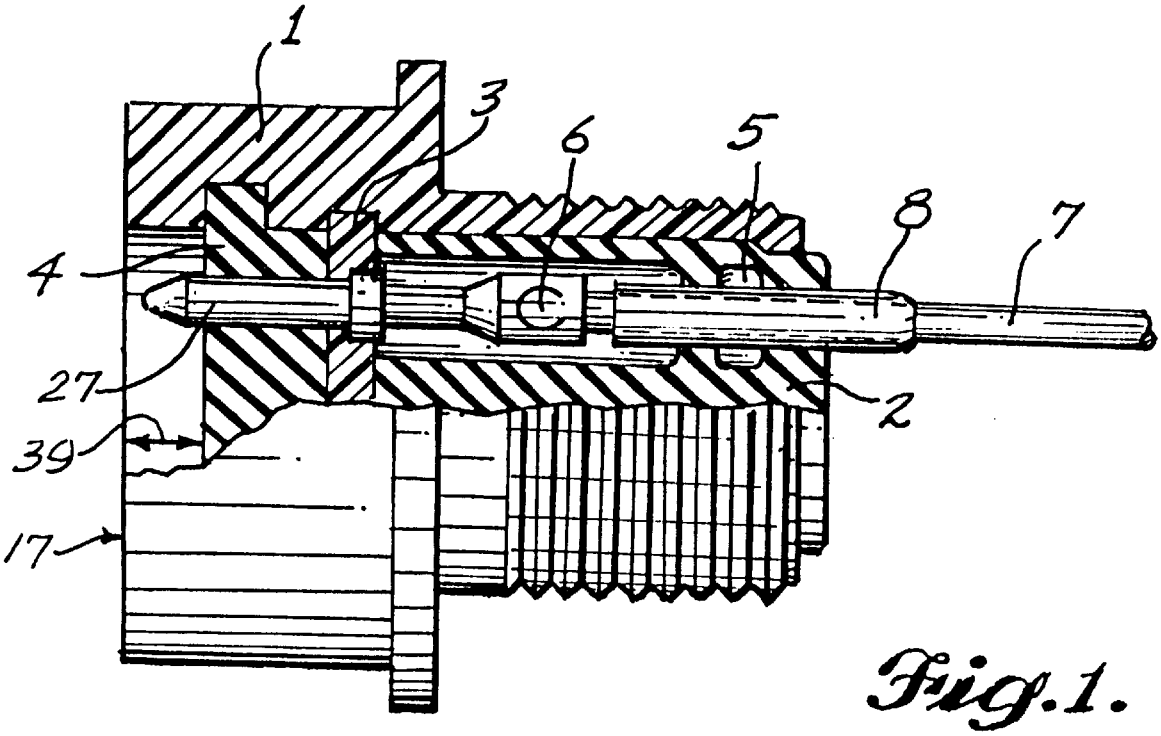
FIG. 1 is a side elevational view of a Mil-C-25600 electrical receptacle connector, a portion thereof being broken away in order to show the connector's internal construction whereby a shrinkable sleeve is added to ensure wire diameter is in accord with the environment resistant requirement of the Mil-C-26500 connectors.

An electrical, circular, environment resisting connector exemplifying the present invention is detailed in its entirety in FIGS. 1–6. A connector of this type comprises a rigid housing 1 containing an environment resistant rubber grommet 2, a rigid dielectric contact retainer 3 and a rubber insert 4. These members all being fixedly retained in the housing 1. Also, pictured is an electrical pin contact 6 crimped to a wire 7 with a shrinkable sleeve 8 used to build up diameter of wire 7. The several members 2–5 encompass and hold in place any preferred number of contacts 6, the precise number depending upon the number of wires 7 to be electrically connected.

Figure 2:
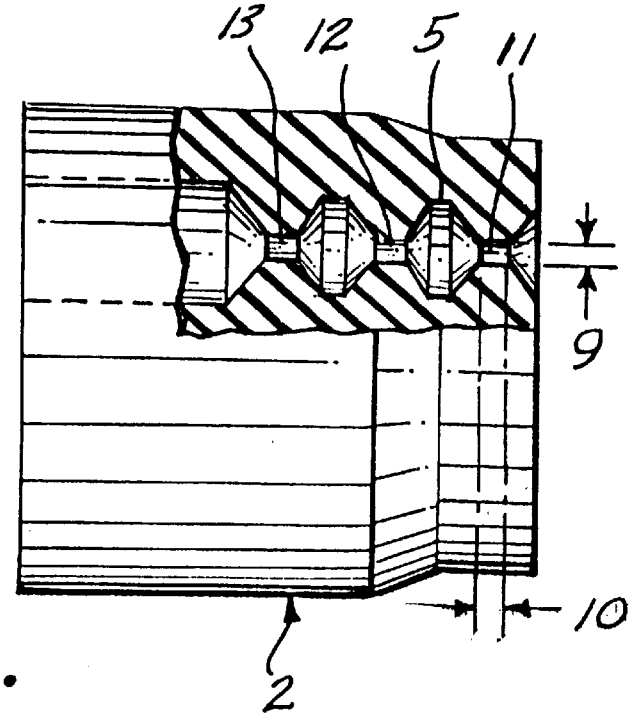
FIG. 2 is a developed view of the present invention environment resisting wire sealing webs having formed in the rubber grommet of the Mil-C-25600 connectors.

Although the function thereof is not readily apparent at this stage of the description, it can be pointed out that the environment resistant property of the rubber grommet 2 is directly attributed to the configured construction on the wire sealing web 5 formed inside the rubber grommet 2. For this description but not limited thereto, the existing seal webbing 5 is constructed to accommodate size 20 contact 6,15 on wire 7 with diameter range of 0.040 to 0.090 in. FIG. 2 is illustrative of the present invention environment resisting rubber grommet 2 having wire sealing web 5 with a wire seal range of 0.035 to 0.090 in. At this time, attention is called to the shape and size of the seal webbing 5 construction in which the smaller diameter 9 of the wire sealing web 5 is now 0.021 to 0.0215 in. but still within the molding manufacturability of the rubber grommet 2. Equally important is the addition of a 0.025 to 0.030 in. flat radius 10 on each of the three wire sealing web convolutions 11–13. This configuration will functionally enable a wider and more positive surface contact area compared to the existing tangential surface contact between wire sealing web convolutions 11–13 and wire 7 thereby providing a significantly better and reliable wire seal.

Figure 3C:
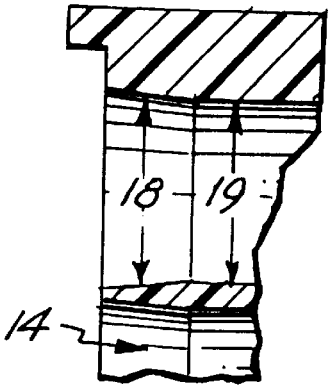
FIGS. 3A–C is a graphical representation illustrating a Mil-C-25600 electrical plug connector having a hard dielectric face socket insert construction. A sectionalized view taken along lines 3B—3B, for the purpose of illustrating the connector insert consisting of two layers of material; in which the insert face is hard dielectric and functionally shaped and then bonded to an elastomeric type rubber forming the insert component of the electrical connector.
Figure 3A:
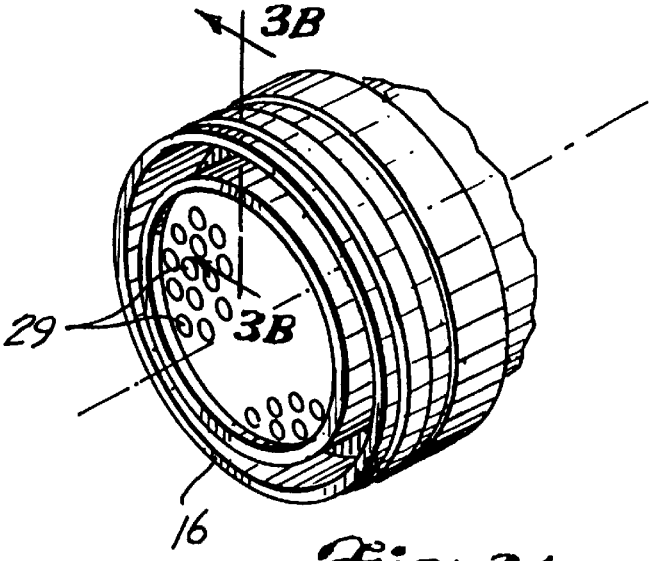
Figure 3B:
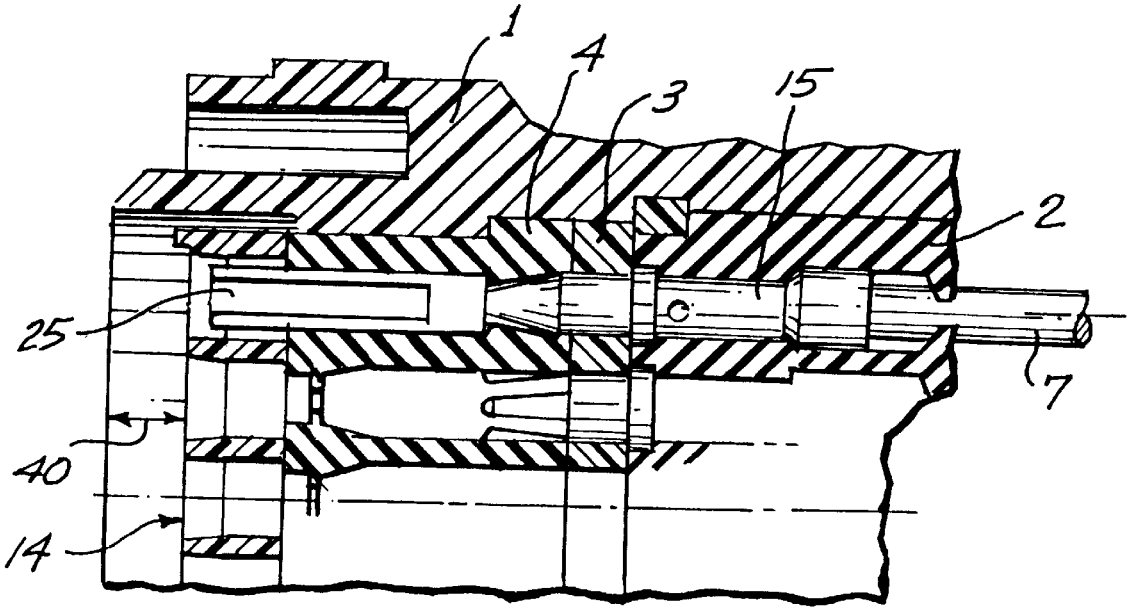

Another feature of the invention is shown in FIG. 3. As described earlier, conventional connector of this type uses a rubber insert 4 on both the plug 16 and receptacle 17 connectors. It should be understood that a plug 16 connector having socket contact 15 coupled to a receptacle 17 connector having a pin contact 6 or vice versa can result in improperly mated pin 6 and socket 15 contacts. This condition exists when mating splayed or bent pin 6 contact into socket 15 contact. It shall be recognized that having a rubber insert 4 will allow the small diameter front end 27 of the bent pin 6 to lay alongside the front end 25 of the socket 15 contact thus resulting to a false connection between pin 6 and socket 15 contacts. Performing a very critical role in the practicing of the invention is a specially configured hard dielectric 14. This hard dielectric 14 is added to the rubber insert 4 only when the rubber insert 4 is used for socket 16 contacts. In order to comply to the dimensional geometry 40 of the Mil-C-25600 receptacle 17 and plug 16 connectors interfacial seal, the layer of hard dielectric 14 is substituted to the removed portion of the rubber insert 4. As can be seen in FIG. 3, a layer of the hard dielectric 14 is bonded radially to the rubber insert 4 when the plug connector 16 or receptacle connector 17 has socket contacts 15. In this regard, it is to be observed that the socket contact hole opening 18 in the hard dielectric 14 has a hole diameter that chamfers down to another contact hole diameter 19 which is smaller in size than the combined diameter of the front end 27A of the pin 16 and front end 27B of the socket 15 contacts. Owing to these dimensional configurations, the possible mating of splayed or bent pin 6 to socket 15 contact is eliminated.

Figure 4:
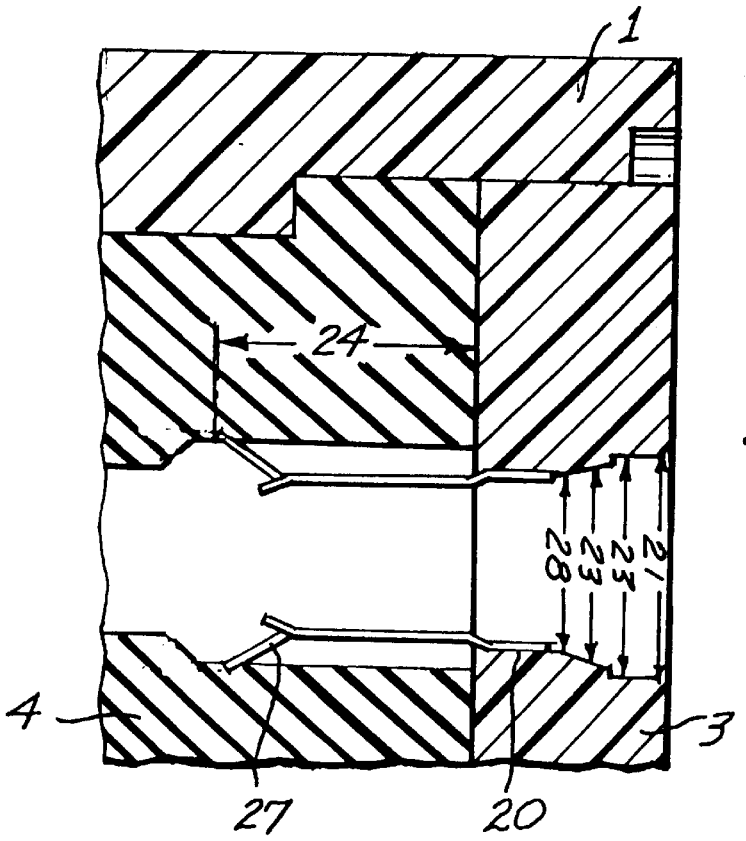
FIG. 4 is a fragmentary view depicting the internal construction of the connector for the purpose of illustrating the shape, size and construction of parts which form the present user friendly attributes on the contact retention clips of Mil-C-26500 connectors.
Figure 5:
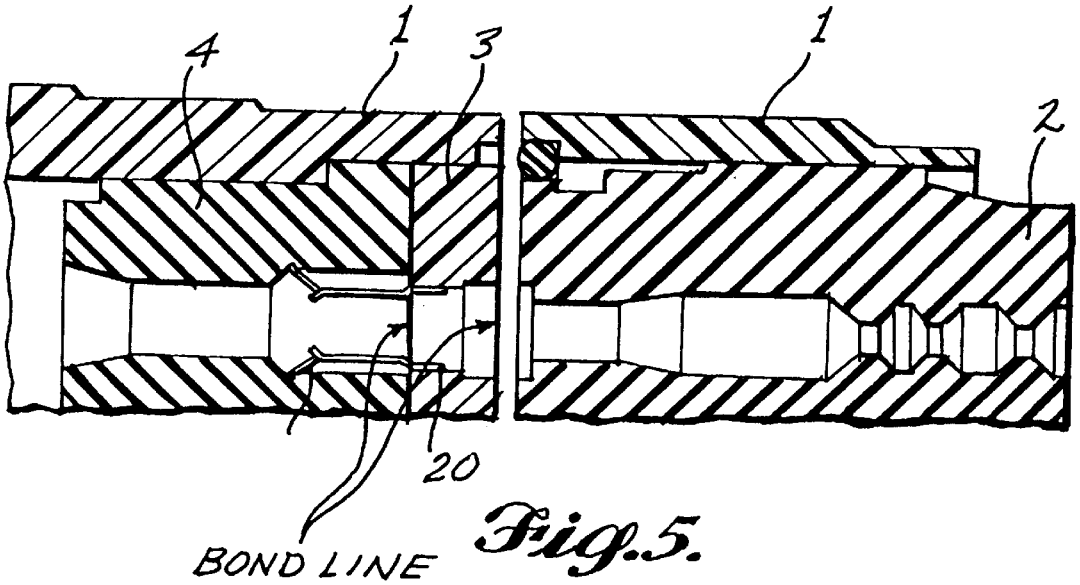
FIG. 5 is another fragmentary view corresponding generally to FIG. 4 but illustrating the criticality of assembling the rubber grommet to the other parts described in FIG. 4.
Figure 6C:
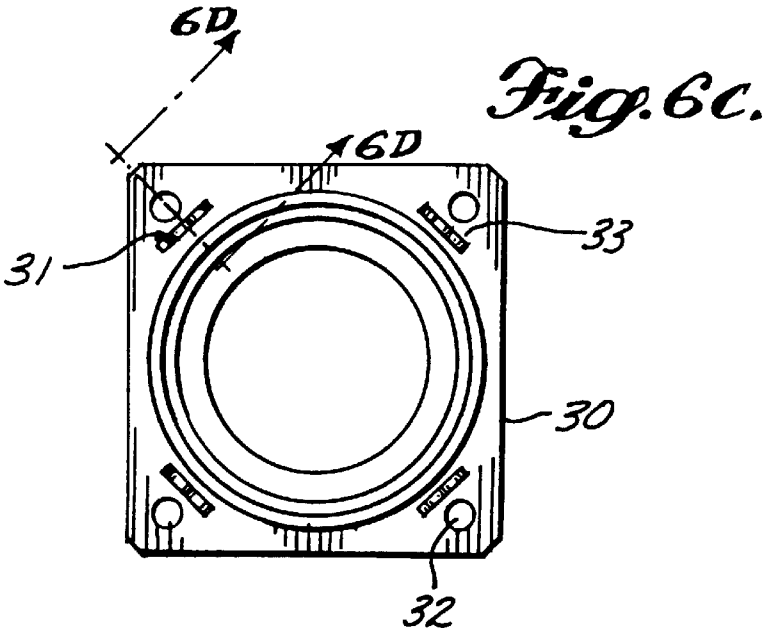
FIGS. 6A–D is a graphical representation illustrating a Mil-C-25600 electrical receptacle connector having a ground wavesprings assembled on the receptacle flange. A detailed view of the ground wavespring and sectionalized view 6C—6C are show for the purpose of illustrating the shape, size and construction of parts as the attributes in the enhancement of maintaining a secure ground path on the receptacle connector to the aircraft panel and/or structure.
Figure 6D:
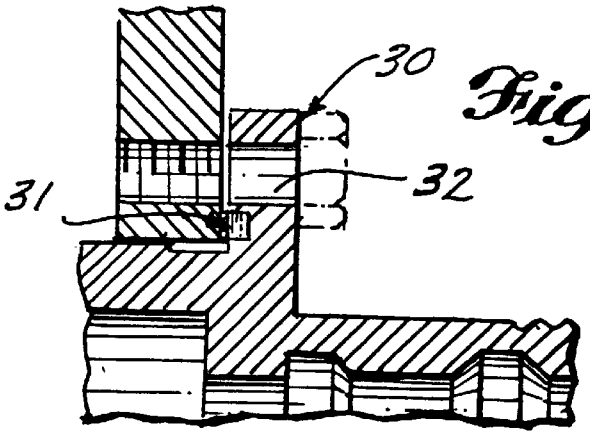
Figure 6A:
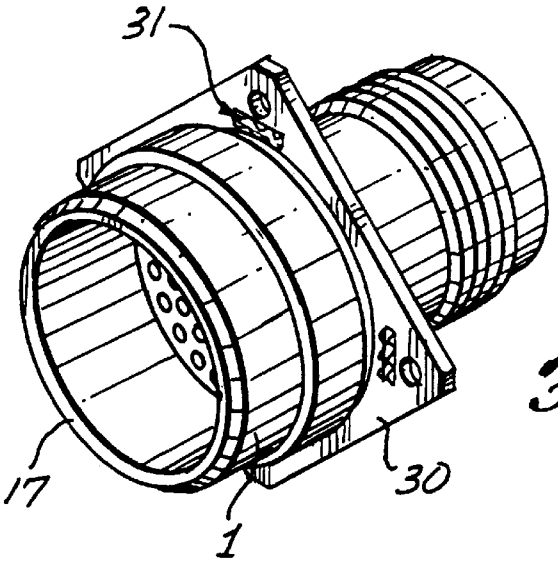
Figure 6B:
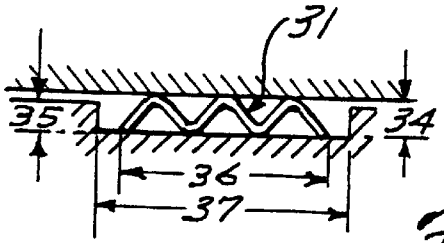

The advantages to be derived from incorporating standardized, user friendly contact retention clips 20 on the Mil-C-25600 connectors are graphically illustrated in FIGS. 4 and 5. It shall be observed that the contact retention clip 20 in the rigid dielectric contact retainer 3 has its hole opening 28 directed at the receiving end of a series of chamfered diameters 21–23. The purpose of this V-shaped construction is to minimize interference and maximize ease of insertion on the pin 6 and socket 15 contacts onto the retention clip 20. Also, attention is called to the construction positioning of the contact retention clip 20 whereby the contact retention clip tines 26 extend beyond the rigid dielectric contact retainer 3 as opposed to prior art wherein the whole retention clip 20 is enclosed in the rigid dielectric contact retainer 3. This permits the contact retention clip tines 26 to expand within the rubber insert 4 when necessary as on removal of contacts 6, 15. Otherwise stated, the advantages can be understood as (1) due to the enlarged opening diameter 21 of the rigid dielectric contact retainer 3 the alignment of the plurality of contact holes 29 on the rubber grommet 2 and rigid dielectric contact retainer 3 is less critical. Stated differently, the radial bonding process between the rubber grommet 2 to the rigid dielectric contact retainer 3 can withstand some misalignment thereby reducing manufacturing cost, (2) insertion and removal of contacts 6, 15 is significantly improved and (3) variation in construction (due to multiple manufacturers) which can lead to handling difficulty is eliminated.

Present airplane requirement on a secure, reliable, consistent electrical connector bonding and grounding is essential to the functionality of critical systems in a fly-by-wire type airplane. This requirement is supported by the present invention by adding grounding wavesprings 31 onto the receptacle 17 connector.

From FIGS. 6A–D it will be further discerned that adjacent to each receptacle 17 connector mounting hole 32 is an outwardly projecting grounding wavespring 31. Positioning proximity of the grounding wavesprings 31 to the connector mounting holes 32 is essential to the assembly interference between the receptacle 17 connector flange and aircraft panel and/or structure 38. For this illustration, but not limited to, is a 0.005 in thick BeNi grounding wavespring 31 which is held stationary in a configured dimensioned slot 33. The face of the slot 33 which runs parallel to the grounding wavespring 31 is deformed in two places and on both sides. The deformation can be a notch which will narrow the slot 33 opening thereby holding the grounding wavespring 31 strategically positioned inside the slot 33. Although, the way it is held stationary is relatively unimportant to the practicing of the invention, it is imperative that its properly adjusted positions, height 34 and length 36, be maintained accordingly to the slot 33 depth 35 and length 37. For this purpose, the grounding wavespring 31 is designed to about 60 percent point of compression or deflection when the receptacle 17 connector is mounted to the aircraft panel and/or structure 38 using mounting screws. It can be understood that the assembly torque on the mounting screws (fasteners) will induce a metal-to-metal compression on the receptacle 17 connector flange and the aircraft panel and/or structure 38 but for some finite time only when relaxation on the fasteners and panel 38 will result to some separation on the connector and aircraft panel and/or structure causing degradation to the connector bonding and grounding. As stated earlier, this condition is not acceptable to the airplane's critical systems functionality. The purpose of the present invention including grounding wavesprings 31 is to bridge at all times any gap between the receptacle 17 connector flange and the aircraft panel and/or structure 38. Simply stated, the grounding wavesprings 31 maintain a continuous, secure, reliable and acceptable (1 mohm or less conductivity resistance) ground path from the receptacle 17 connector to the aircraft panel and/or structure 38.

What is claimed is:

1. A Mil-C-25600 type electrical connector comprising:

an environmentally resistant rubber grommet having wire sealing webs and an improved contact means;

said environmentally resistant rubber grommet bonded onto a rigid contact retainer whereby a contact retainer receiving end is configured with a series of tapered diameter holes to facilitate assembly into formed contact retention clips of said rigid contact retainer;

said rigid contact retainer bonded onto a rubber insert having a layer of hard dielectric on said rubber insert; and a housing shell which envelopes said bonded components of rubber grommet, rigid contact retainer and rubber insert.

2. A MiL-C-26500 type electrical connector comprising:

an environment resisting rubber grommet with a plurality of electrical contact holes having wire sealing webs formed within each hole, wherein the improvement comprises:

said wire sealing webs configured to enable a tighter, wider and more positive contact area between said sealing webs and wire;

a rigid contact retainer having a plurality of electrical contact holes, each hole having formed contact retention clips secured onto the said rigid contact retainer and commonly located below the face surface on said electrical contact holes, wherein the improvement comprises:

said face surface on said electrical contact holes comprising the receiving end of said rigid contact retainer having a series of tapered diameter holes for guiding and facilitating the loading and insertion on the pin and socket contacts onto said formed contact retention clips;

said contact retention clips having tines extending to the outside of said rigid contact retainer and enclosed within the hole of the rubber insert;

a rubber insert with a plurality of electrical contact holes having a layer of hard dielectric bonded radially onto the front area of said rubber insert when said electrical connector utilizes electrical socket contacts;

a housing shell which envelopes radially bonded components of said rubber grommet, said rigid contact retainer having contact retention clips and a rubber insert; and a plug coupling ring mounted onto the connector housing shell, and further including a receptacle having a mounting flange as part of said connector housing shell, and a grounding wavespring onto the flange of said receptacle connector.

3. A Mil-C-25600 type electrical connector according to claim 2 having a wire sealing diameter range accommodation consisting of:

0.035 to 0.090 in for size 20 contacts 0.065 to 0.130 in for size 16 contacts 0.075 to 0.140 in for size 12 contacts.

4. A Mil-C-25600 type electrical connector according to claim 2 further including a flat radius on each tip of three wire sealing web convolutions thereby providing a reliable wire seal.

5. A Mil-C-25600 type electrical connector according to claim 2 wherein said series of tapered diameter holes form a V-shaped opening on each contact hole in said rigid contact retainer thereby providing a receiving area for an electrical contact assembly.

6. A Mil-C-25600 type electrical connector according to claims 2 and 5 wherein formed retention clips in said rigid contact retainer receive said electrical contacts without bias to the straightness on said electrical contact during insertion assembly.

7. A Mil-C-25600 type electrical connector according to claim 6 wherein said electrical contacts are fixedly received in said retention clips.

8. A Mil-C-25600 type electrical connector according to claim 2 wherein assembly of formed retention clips onto said rigid contact retainer include tines of said retention clip positioned beyond the confines of said rigid contact retainer.

9. A Mil-C-25600 type electrical connector according to claim 8 where said retention clip tines are enclosed within the hole of the rubber insert thereby enabling user friendly removal of said electrical contacts.

10. A Mil-C-25600 type electrical connector according to claim 2 wherein the rubber insert has a layer of hard dielectric and a hole diameter in each of a multiplicity of holes for said electrical contacts in said hard dielectric smaller in diameter than the combined diameter of said pin and socket electrical contacts.

11. A Mil-C-25600 type electrical connector according to claim 10 wherein coupling of splayed electrical contacts, pin and socket, is detectable and unengageable.

12. A Mil-C-25600 type electrical connector according to claim 11 wherein bent electrical pin contact produces a restraining movement when engaging the mating socket contact.

13. A Mil-C-25600 type electrical connector according to claim 2 wherein grounding wavesprings are positioned along the mounting holes on said receptacle flange and outwardly project in assembly.

14. A Mil-C-25600 type electrical connector according to claim 13 wherein outwardly projecting grounding wavesprings are fixedly secured within a slot on said receptacle flange with preloadable deflection on said grounding wavespring during connector installation.

15. A Mil-C-25600 type electrical connector according to claim 14 wherein the grounding wavesprings bridge the gap between receptacle flange and aircraft structure; said gap or dielectric condition caused by metal relaxation on both flange and structure elongation on connector mounting screws.

16. A Mil-C-25600 type electrical connector according to claim 14 having interengageable contact means for advancing said grounding wavesprings with respect to the opposite movement of said connector flange and aircraft structure.

17. A Mil-C-25600 type electrical connector according to claim 2 wherein said connector has contact retention clips which provides access for insertion and removal of electrical contacts, unengageable pin and socket contacts on each half of a mated connector when a pin contact is bent or splayed, and grounding wavesprings which ensure continuous electrical bonding and grounding between mounted connector and aircraft structure.

* * * * *